US007306360B2

(12) United States Patent
Lin

(10) Patent No.: US 7,306,360 B2
(45) Date of Patent: Dec. 11, 2007

(54) DECORATIVE LIGHTING DEVICE

(76) Inventor: Vincent Lin, No. 39, Sec. 3, Chung-Hua Rd., Hsin-Chu City (TW)

( * ) Notice: Subject to any disclaimer, the term of this patent is extended or adjusted under 35 U.S.C. 154(b) by 198 days.

(21) Appl. No.: 11/324,248

(22) Filed: Jan. 4, 2006

(65) Prior Publication Data

US 2007/0153531 A1 Jul. 5, 2007

(51) Int. Cl.
*H01R 33/00* (2006.01)
*F21V 29/00* (2006.01)

(52) U.S. Cl. ..... 362/653; 362/267; 362/652; 362/645; 362/806

(58) Field of Classification Search ..... 362/652–655, 362/644–647, 649, 650, 362, 311, 351, 353, 362/806, 252, 374, 375, 434–437; 439/419, 439/699.2; 313/318.01, 318.04, 318.09
See application file for complete search history.

(56) References Cited

U.S. PATENT DOCUMENTS 3,849,640 A * 11/1974 McCarthy ..... 362/437
4,679,126 A * 7/1987 Van Sickler ..... 362/654
5,517,394 A * 5/1996 Lin ..... 362/353
5,816,686 A * 10/1998 Wang et al. ..... 362/653
6,022,241 A * 2/2000 Lin ..... 362/653
6,514,105 B2 * 2/2003 Lin ..... 362/653

* cited by examiner

*Primary Examiner*—Sandra O'Shea
*Assistant Examiner*—Bao Q. Truong
(74) *Attorney, Agent, or Firm*—Pillsbury Winthrop Shaw Pittman, LLP

(57) ABSTRACT

A decorative lighting device includes: a light-emitting unit; a holding unit which includes an inner surrounding wall that has an outer wall surface, an outer surrounding wall that has a surrounding engaging surface spaced apart from the outer wall surface with a surrounding clearance, and an annular connecting wall that attaches the outer surrounding wall to the outer wall surface to form a surrounding abutment surface confronting the surrounding clearance; and a light-transmissive housing which includes an annular neck portion that terminates at an annular edge, that has inner and outer annular surfaces, and that is configured such that once the annular edge is brought to abut against the surrounding abutment surface, the outer annular surface is engaged with the surrounding engaging surface, while the inner annular surface is spaced apart from the outer wall surface to thereby cut off creepage of intruding extraneous water into the inner surrounding wall.

6 Claims, 5 Drawing Sheets

DECORATIVE LIGHTING DEVICE

BACKGROUND OF THE INVENTION

1. Field of the Invention

The invention relates to a decorative lighting device, more particularly to a decorative lighting device that has enhanced heat-isolation and waterproof effects.

2. Description of the Related Art

As shown in FIG. 1 and FIG. 2, a conventional decorative lighting device 1 includes a light-emitting unit 11, a holding unit 12, and two electric wires 13.

The light-emitting unit 11 includes a plug-in base 112 and a light bulb 111. The plug-in base 112 is made from an insulating material, and includes upper and lower bodies 113, 114 disposed opposite to each other along an axis (X1). The upper body 113 defines a bulb-receiving space 118. The lower body 114 includes a lateral guiding wall 116 extending downwardly from the upper body 113 along the axis (X1). The light bulb 111 has a lower bulb portion 117, and two lead-in wires 115 which extend downwardly and outwardly of the lower bulb portion 117, and which are configured such that when the lower bulb portion 117 is inserted into the bulb-receiving space 118, the two lead-in wires 115 extend downwardly and outwardly of the upper body 113 of the plug-in base 112 to have the lateral guiding wall 116 interposed therebetween.

The holding unit 12 is made from an insulating material (e.g., plastic), extends downwardly along the axis (X1), and includes a holding body 122 which confines a holding space 125, and two electrical terminals 121. The two electrical terminals 121 are disposed to be secured to an inner wall surface 123 of the holding body 122 such that once the lower body 114 of the plug-in base 112 is brought to be fitted into the holding space 125 by virtue of sliding movement of the lateral guiding wall 116 relative to the inner wall surface 123, the two lead-in wires 115 are brought into electrical contact with the two electrical terminals 121, respectively.

The two electric wires 13 extend into the holding space 125 and are in electrical contact with the two electrical terminals 121, respectively.

As shown in FIG. 2, the holding body 122 of the holding unit 12 is configured such that when the plug-in base 112 of the light-emitting unit 11 is received in the holding space 125, while the electric wires 13 extend into the holding space 125, the plug-in base 12 and the electric wires 13 are placed securely in the holding space 125 so as to prevent water from entering thereinto, and so as to ensure good electrical contact among the two lead-in wires 115, the two electrical terminals 121, and the two electric wires 13.

A plurality of the conventional decorative lighting devices 1 can be connected in series to form a lamp assembly (not shown) to facilitate decorative applications. When one of the conventional decorative lighting devices 1 in the lamp assembly is damaged due to long-term usage or other reasons, electric current flowing through the rest of the conventional decorative lighting devices 1 (i.e., the non-damaged conventional decorative lighting devices) increases accordingly. However, as the electric current flowing through the conventional decorative lighting device 1 increases, heat dissipation increases in a square function, resulting in an increase in temperature that can easily over heat the light bulb 111. Under this situation, there is a greater possibility for the non-damaged conventional decorative lighting devices 1 to break down. In addition, when the holding unit 12, which is made from an insulating material, gets in contact with one of the overheated non-damaged conventional decorative lighting devices 1, the holding unit 12 can melt easily, exposing the electrical terminals 121, and putting individuals who accidentally touch the exposed electrical terminals 121 in danger. Therefore, the conventional decorative lighting device 1 does not meet the safety standards set out by Underwriters Laboratories Inc., and is in need of improvements.

SUMMARY OF THE INVENTION

Therefore, the object of the present invention is to provide a decorative lighting device that has enhanced heat-isolation and waterproof effects so as to ensure safety thereof.

According to the present invention, there is provided a decorative lighting device that includes a light-emitting unit, a holding unit, and a light-transmissive body. The light-emitting unit includes a plug-in base and a light bulb. The plug-in base is made from an insulating material, and includes upper and lower bodies disposed opposite to each other along an axis. The upper body includes an end wall surface that has a cavity extending towards the lower body to define a bulb-receiving space. The lower body includes two lateral guiding walls which are opposite to each other in a transverse direction relative to the axis. The light bulb has a lower bulb portion, and first and second lead-in wires which extend downwardly and outwardly of the lower bulb portion, and which are configured such that when the lower bulb portion is inserted into the bulb-receiving space, the first and second lead-in wires extend downwardly and outwardly of the upper body of the plug-in base to be located between the two lateral guiding walls in the transverse direction. The holding unit is made from an insulating material, and includes inner and outer surrounding walls, an annular connecting wall, and two electrical terminals. The inner surrounding wall extends downwardly along the axis to terminate at an inner surrounding edge, and has inner and outer wall surfaces opposite to each other in radial directions relative to the axis. The outer surrounding wall extends downwardly along the axis to terminate at an outer surrounding edge, and has a surrounding engaging surface that confronts and that is spaced apart from the outer wall surface of the inner surrounding wall with a surrounding clearance. The annular connecting wall extends radially from the outer surrounding edge to attach to the outer wall surface of the inner surrounding wall that is proximate to the inner surrounding edge so as to form a surrounding abutment surface which confronts the surrounding clearance. The two electrical terminals are disposed to be secured to the inner wall surface of the inner surrounding wall such that once the lower body of the plug-in base is brought to be fitted into the inner surrounding wall by virtue of sliding movement of the two lateral guiding walls relative to the inner wall surface, the first and second lead-in wires are brought into electrical contact with the electrical terminals, respectively. The light-transmissive housing defines a hollow chamber for receiving the light-emitting unit therein, and includes an annular neck portion which extends along the axis to terminate at an annular edge that defines an opening to provide access into the hollow chamber, and which has inner and outer annular surfaces opposite to each other in radial directions. The annular neck portion is configured such that once the annular edge is brought to abut against the surrounding abutment surface of the annular connecting wall, the outer annular surface is engaged with the surrounding engaging surface of the outer surrounding wall, while the inner annular surface is spaced apart from the outer wall surface of the inner surrounding wall to thereby cut off creepage of intruding extraneous water into the inner surrounding wall.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
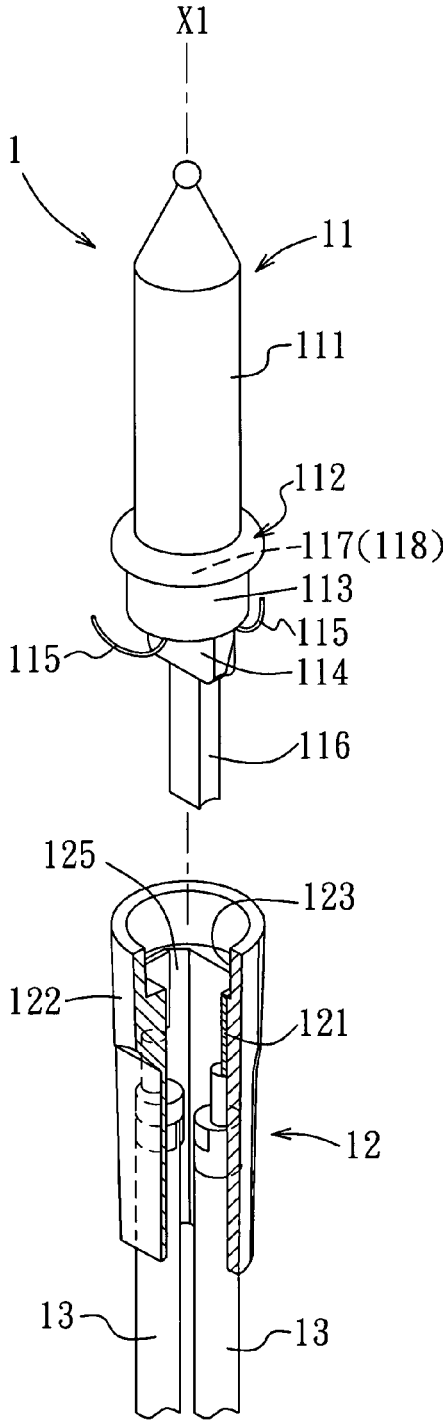
FIG. 1 PRIOR ART
FIG. 1 is a partly exploded, partly cutaway, perspective view of a conventional decorative lighting device.
Figure 2:
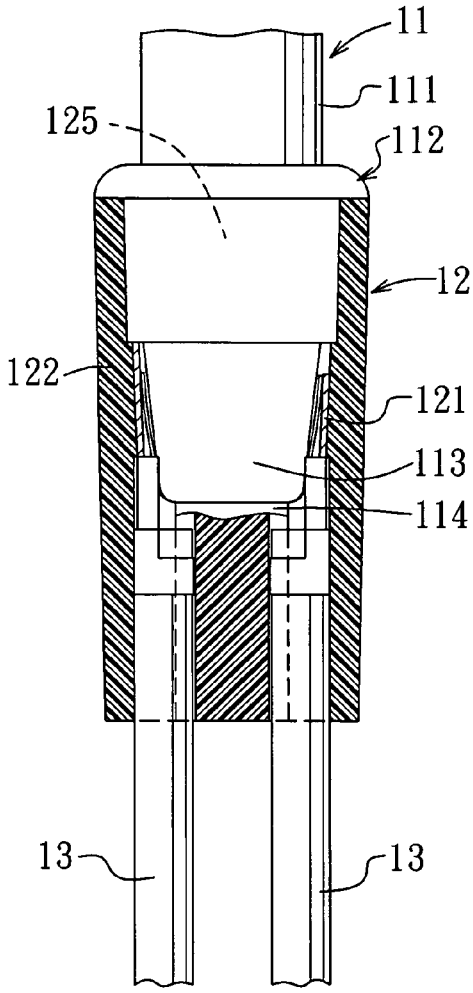
FIG. 2 PRIOR ART
FIG. 2 is a fragmentary partly sectional view of the conventional decorative lighting device.
Figure 3:
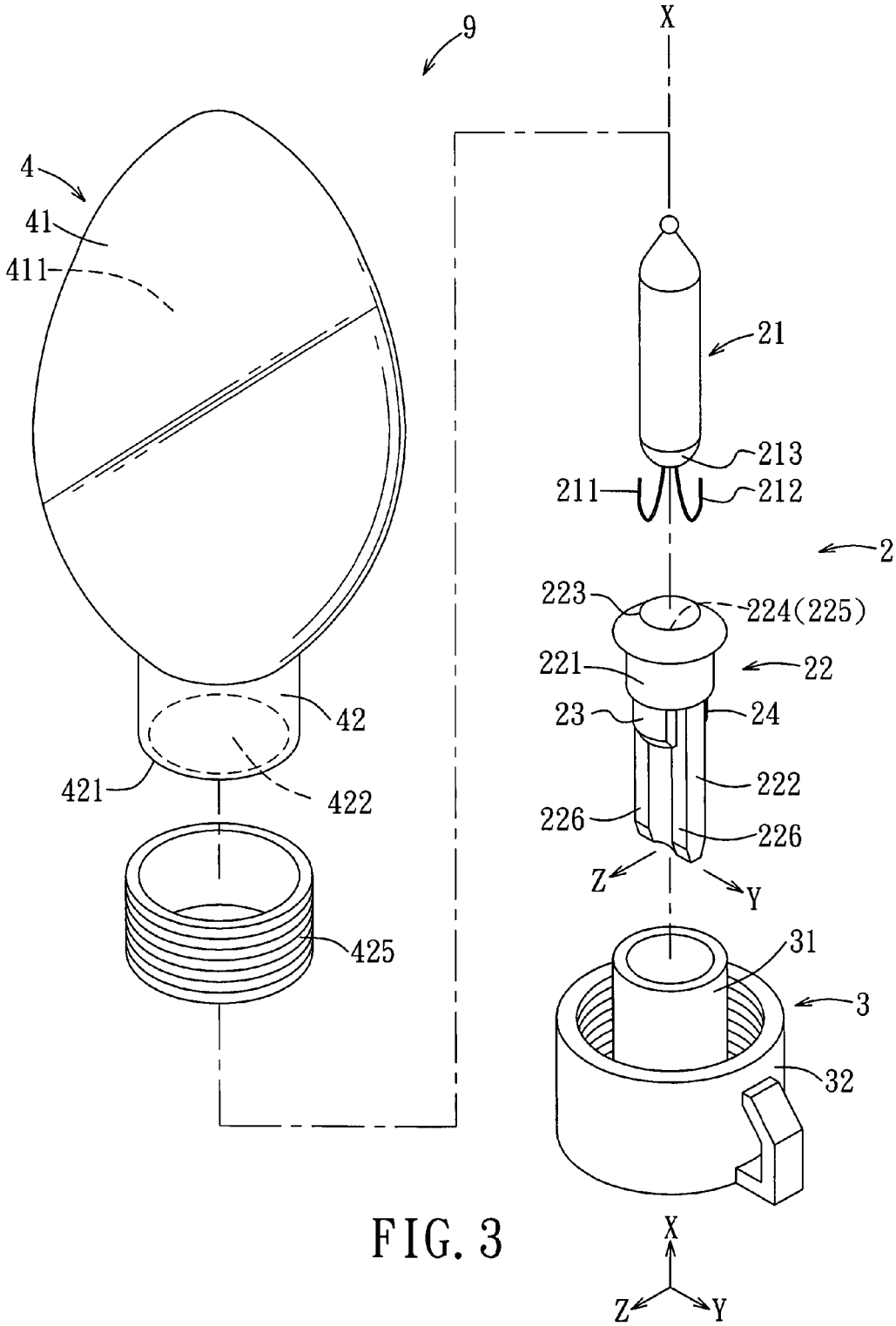
FIG. 3 is an exploded perspective view of a preferred embodiment of a decorative lighting device according to the present invention.
Figure 4:
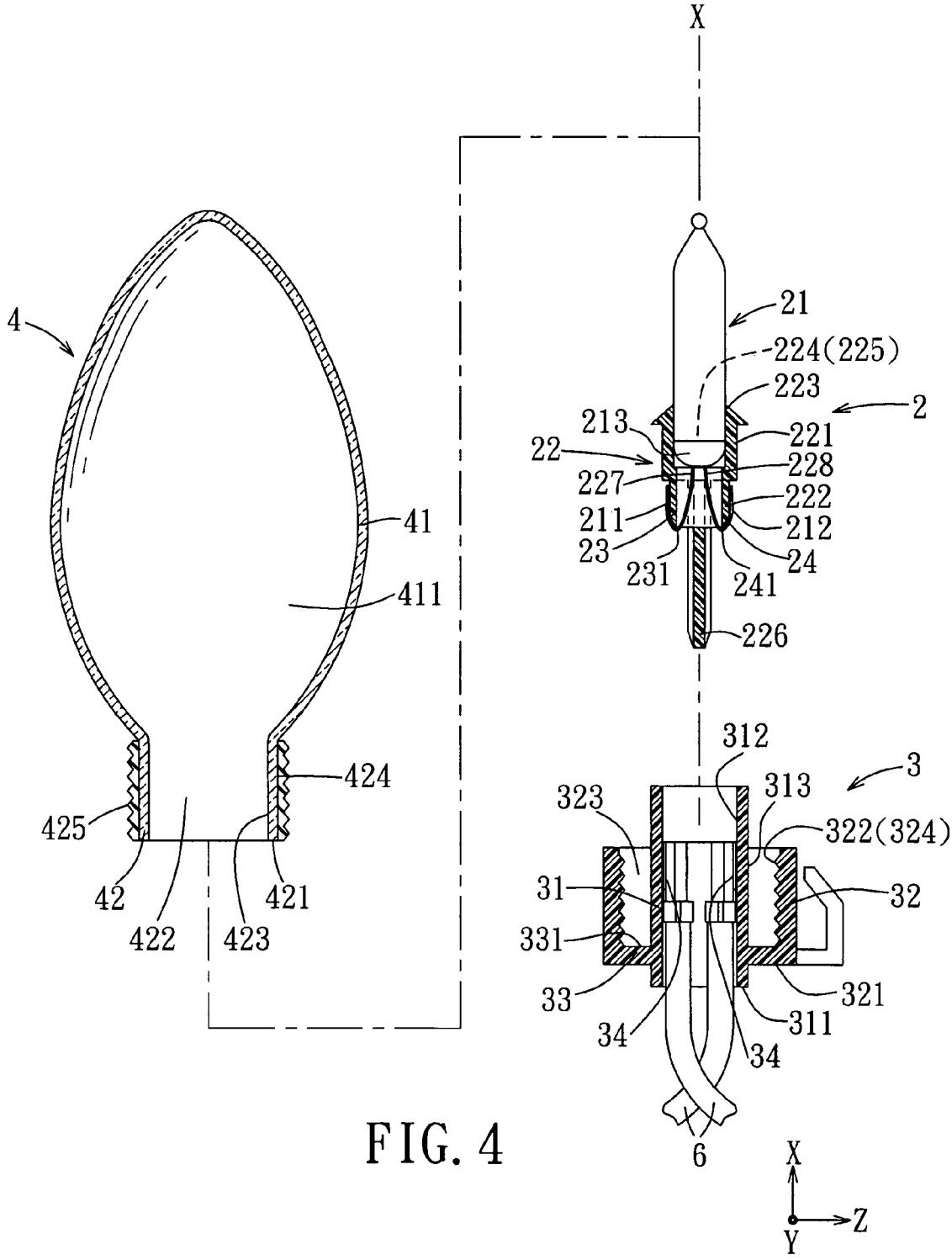
FIG. 4 is an exploded sectional view of the preferred embodiment.

As shown in FIG. 3 and FIG. 4, the preferred embodiment of a decorative lighting device 9 according to the present invention includes a light-emitting unit 2, a holding unit 3, and a light-transmissive body 4.

The light-emitting unit 2 includes a plug-in base 22 and a light bulb 21. The plug-in base 22 is made from an insulating material (e.g., plastic), and includes upper and lower bodies 221, 222 disposed opposite to each other along an axis (X). The upper body 221 includes an end wall surface 223 that has a cavity 224 extending towards the lower body 222 to define a bulb-receiving space 225. The lower body 222 includes two lateral guiding walls 226 (only one is shown in FIG. 4) which are opposite to each other in a first transverse direction (Y) relative to the axis (X). The light bulb 21 has a lower bulb portion 213, and first and second lead-in wires 211, 212 which extend downwardly and outwardly of the lower bulb portion 213, and which are configured such that when the lower bulb portion 213 is inserted into the bulb-receiving space 225, the first and second lead-in wires 211, 212 extend downwardly and outwardly of the upper body 221 of the plug-in base 22 to be located between the two lateral guiding walls 226 in the first transverse direction (Y).

The light-emitting unit 2 further includes right and left urging lugs 23, 24 disposed between the two lateral guiding walls 226 of the lower body 222 of the plug-in base 22 to permit the first and second lead-in wires 211, 212 of the light bulb 21 led out of the upper body 221 of the plug-in base 22 to be disposed outboard to the right and left urging lugs 23, 24, respectively, in a second transverse direction (Z) transverse to the axis (X) and the first transverse direction (Y). The upper body 221 of the plug-in base 22 has right and left through holes 227, 228 spaced apart from each other for the first and second lead-in wires 211, 212 to pass respectively therethrough to extend downwardly and outwardly of the upper body 221. Each of the right and left urging lugs 23, 24 has a bottom through hole 231, 241 in spatial communication with a respective one of the right and left through holes 227, 228 to permit the first and second lead-in wires 211, 212 led out of the upper body 221 to be disposed outboard to the right and left urging lugs 23, 24, respectively.

The holding unit 3 is made from an insulating material, and includes inner and outer surrounding walls 31, 32, an annular connecting wall 33, and two electrical terminals 34. The inner surrounding wall 31 extends downwardly along the axis (X) to terminate at an inner surrounding edge 311, and has inner and outer wall surfaces 312, 313 opposite to each other in radial directions relative to the axis (X). The outer surrounding wall 32 extends downwardly along the axis (X) to terminate at an outer surrounding edge 321, and has a surrounding engaging surface 322 that confronts and that is spaced apart from the outer wall surface 313 of the inner surrounding wall 31 with a surrounding clearance 323. The annular connecting wall 33 extends radially from the outer surrounding edge 321 to attach to the outer wall surface 313 of the inner surrounding wall 31 that is proximate to the inner surrounding edge 311 so as to form a surrounding abutment surface 331 which confronts the surrounding clearance 323. The two electrical terminals 34 are disposed to be secured to the inner wall surface 312 of the inner surrounding wall 31 such that once the lower body 222 of the plug-in base 22 is brought to be fitted into the inner surrounding wall 31 by virtue of sliding movement of the two lateral guiding walls 226 relative to the inner wall surface 312, the first and second lead-in wires 211, 212 are brought into electrical contact with the electrical terminals 34, respectively.

The light-transmissive housing 4 includes a light-transmissive body 41 which defines a hollow chamber 411 for receiving the light-emitting unit 2 therein, and which is made from a glass material, and an annular neck portion 42 which extends downwardly from the light-transmissive body 41 along the axis (X) to terminate at an annular edge 421 that defines an opening 422 to provide access into the hollow chamber 411, and which has inner and outer annular surfaces 423, 424 opposite to each other in radial directions relative to the axis (X). The annular neck portion 42 is configured such that once the annular edge 421 is brought to abut against the surrounding abutment surface 331 of the annular connecting wall 33, the outer annular surface 424 is engaged with the surrounding engaging surface 322 of the outer surrounding wall 32, while the inner annular surface 323 is spaced apart from the outer wall surface 313 of the inner surrounding wall 31 to thereby cut off creepage of intruding extraneous water (not shown) into the inner surrounding wall 31.

In this embodiment, the surrounding engaging surface 322 of the outer surrounding wall 32 is provided with an inner thread 324. The outer annular surface 424 of the annular neck portion 42 of the light-transmissive housing 4 is provided with an outer thread 425 that is made from a flexible material, and that engages threadedly the inner thread 324 such that the outer annular surface 424 is securely mounted to the surrounding engaging surface 322. In addition, the decorative lighting device 9 further includes two electric wires 6 disposed to connect electrically to the two electrical terminals 34 of the holding unit 3, respectively.

Figure 5:
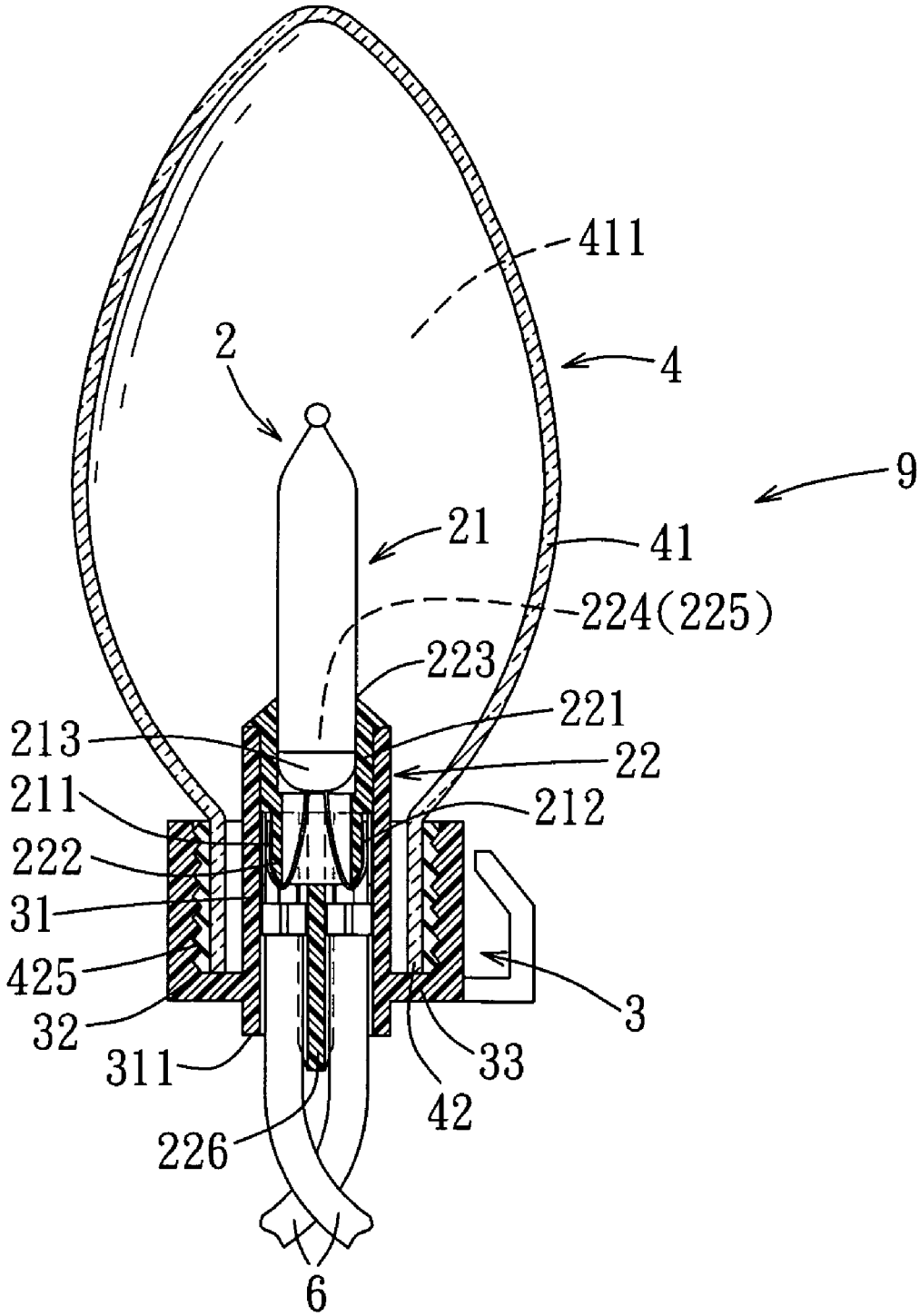
FIG. 5 is an assembled sectional view of the preferred embodiment.

With further reference to FIG. 5, to assemble the decorative lighting device 9, the lower bulb portion 213 of the light bulb 21 is first inserted into the bulb-receiving space 225 such that the first and second lead-in wires 211, 212 extend sequentially through the respective one of the right and left through holes 227, 228 in the upper body 221 of the plug-in base 22, and the bottom through hole 231, 241 in the respective one of the right and left urging lugs 23, 24, outwardly of the upper body 221 of the plug-in base 22, and outboard to the respective one of the right and left urging lugs 23, 24. Subsequently, the lower body 222 of the plug-in base 22 is inserted into the inner surrounding wall 31 such that the first and second lead-in wires 211, 212 are in electrical contact with the respective one of the electrical terminals 34, respectively. The electric wires 6 are then extended into the inner surrounding wall 31 to be disposed in electrical contact with the electrical terminals 34, respectively, thereby establishing electrical contact between the first and second lead-in wires 211, 212 and the electric wires 6, respectively. Lastly, the outer thread 425 of the annular neck portion 42 of the light-transmissive housing 4 is engaged threadedly with the inner thread 324 of the surrounding engaging surface 322 such that the annular neck portion 42 is received in the surrounding clearance 323 and such that the light-emitting unit 2 is disposed in the hollow chamber 411, until the annular edge 421 abuts against the surrounding abutment surface 331 of the annular connecting wall 33 to cut off creepage of intruding extraneous water (not shown) into the inner surrounding wall 31.

Figure 6:
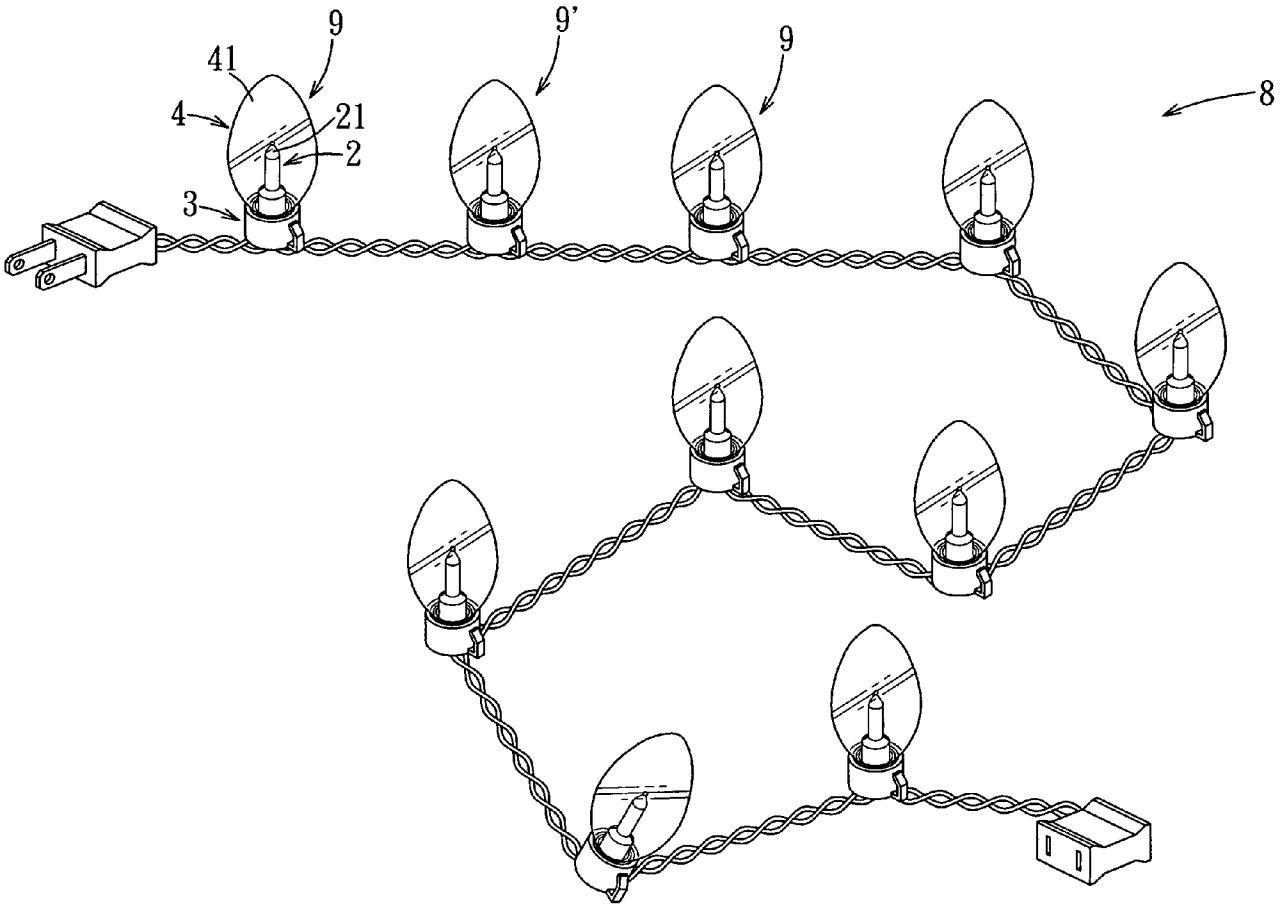
FIG. 6 is a schematic view illustrating a preferred embodiment of a lamp assembly according to the present invention.

As shown in FIG. 6, the preferred embodiment of a lamp assembly 8 according to the present invention includes a plurality of the decorative lighting devices 9 of the previous embodiment. The decorative lighting devices 9 are connected in series to form the lamp assembly 8. When one of the decorative lighting devices in the lamp assembly 8 is damaged (hereinafter referred to as the damaged decorative lighting device 9'), the temperatures of the light bulbs 21 of the rest of the decorative lighting devices 9 (hereinafter referred to as the non-damaged decorative lighting devices 9) increase due to an increased flow of electric current therethrough. The heated light bulbs 21 can cause a rise in the temperature of a respective one of the light-transmissive bodies 41 to overheat as well, which can result in melting of the holding unit 3. However, with reference to FIG. 4, the inner surrounding wall 31 of the holding unit 3 is not in contact with the corresponding light-transmissive body 41, and is thereby prevented from melting, due to the presence of the surrounding clearance 323, and due to the fact that the inner annular surface 423 of the annular neck portion 42 is spaced apart from the outer wall surface 313 of the inner surrounding wall 31. In this manner, the electrical terminals 34 are prevented from being exposed to the environment so as to protect users from danger.

Therefore, it has been shown that due to the configuration of the holding unit 3 and the spatial relationship thereof with the light-transmissive housing 4, the decorative lighting device 9 according to the present invention has enhanced heat-isolation and waterproof effects to ensure the safety thereof.

While the present invention has been described in connection with what is considered the most practical and preferred embodiments, it is understood that this invention is not limited to the disclosed embodiments but is intended to cover various arrangements included within the spirit and scope of the broadest interpretation and equivalent arrangements.

What is claimed is:

1. A decorative lighting device comprising:

a light-emitting unit including a plug-in base made from an insulating material, and including upper and lower bodies disposed opposite to each other along an axis, said upper body including an end wall surface that has a cavity extending towards said lower body to define a bulb-receiving space, said lower body including two lateral guiding walls which are opposite to each other in a first transverse direction relative to the axis, and a light bulb having a lower bulb portion, and first and second lead-in wires which extend downwardly and outwardly of said lower bulb portion, and which are configured such that when said lower bulb portion is inserted into said bulb-receiving space, said first and second lead-in wires extend downwardly and outwardly of said upper body of said plug-in base to be located between said two lateral guiding walls in the first transverse direction;

a holding unit made from an insulating material and including an inner surrounding wall which extends downwardly along the axis to terminate at an inner surrounding edge, and which has inner and outer wall surfaces opposite to each other in radial directions relative to the axis, an outer surrounding wall which extends downwardly along the axis to terminate at an outer surrounding edge, and which has a surrounding engaging surface that confronts and that is spaced apart from said outer wall surface of said inner surrounding wall with a surrounding clearance, an annular connecting wall extending radially from said outer surrounding edge to attach to said outer wall surface of said inner surrounding wall that is proximate to said inner surrounding edge so as to form a surrounding abutment surface which confronts said surrounding clearance, and two electrical terminals disposed to be secured to said inner wall surface of said inner surrounding wall such that once said lower body of said plug-in base is brought to be fitted into said inner surrounding wall by virtue of sliding movement of said two lateral guiding walls relative to said inner wall surface, said first and second lead-in wires are brought into electrical contact with said two electrical terminals, respectively; and a light-transmissive housing defining a hollow chamber for receiving said light-emitting unit therein, and including an annular neck portion which extends along the axis to terminate at an annular edge that defines an opening to provide access into said hollow chamber, and which has inner and outer annular surfaces opposite to each other in radial directions, said annular neck portion being configured such that once said annular edge is brought to abut against said surrounding abutment surface of said annular connecting wall, said outer annular surface is engaged with said surrounding engaging surface of said outer surrounding wall, while said inner annular surface is spaced apart from said outer wall surface of said inner surrounding wall to thereby cut off creepage of intruding extraneous water into said inner surrounding wall.

2. The decorative lighting device as claimed in claim 1, wherein said surrounding engaging surface of said outer surrounding wall is provided with an inner thread;

said outer annular surface of said annular neck portion of said light-transmissive housing being provided with an outer thread to engage threadedly said inner thread such that said outer annular surface is securely mounted to said surrounding engaging surface.

3. The decorative lighting device as claimed in claim 2, wherein said outer thread is made from a flexible material.

4. The decorative lighting device as claimed in claim 1, wherein said light-transmissive housing further includes a light-transmissive body which is connected to said annular neck portion, which defines said hollow chamber, and which is made from a glass material.

5. The decorative lighting device as claimed in claim 1, wherein said light-emitting unit further includes right and left urging lugs disposed between said two lateral guiding walls of said lower body of said plug-in base to permit said first and second lead-in wires of said light bulb led out of said upper body of said plug-in base to be disposed outboard to said right and left urging lugs, respectively, in a second transverse direction transverse to the axis and the first transverse direction.

6. The decorative lighting device as claimed in claim 5, wherein said upper body of said plug-in base has right and left through holes spaced apart from each other for said first and second lead-in wires to pass respectively therethrough to extend downwardly and outwardly of said upper body;

each of said right and left urging lugs having a bottom through hole in spatial communication with a respective one of said right and left through holes in said upper body of said plug-in base to permit said first and second lead-in wires led out of said upper body to be disposed outboard to said right and left urging lugs, respectively.

* * * * *